US010982689B2

(12) United States Patent
Owesson et al.

(10) Patent No.: US 10,982,689 B2
(45) Date of Patent: Apr. 20, 2021

(54) SUBMERSIBLE MACHINE GUIDE ASSEMBLY

(71) Applicant: Xylem Europe GmbH, Schaffhausen (CH)

(72) Inventors: Håkan Owesson, Spånga (SE); Nermin Keles, Skärholmen (SE)

(73) Assignee: Xylem Europe GmbH, Schaffhausen (CH)

( * ) Notice: Subject to any disclaimer, the term of this patent is extended or adjusted under 35 U.S.C. 154(b) by 105 days.

(21) Appl. No.: 16/476,346

(22) PCT Filed: Jan. 8, 2018

(86) PCT No.: PCT/EP2018/050311
§ 371 (c)(1),
(2) Date: Jul. 8, 2019

(87) PCT Pub. No.: WO2018/127579
PCT Pub. Date: Jul. 12, 2018

(65) Prior Publication Data

US 2020/0040913 A1 Feb. 6, 2020

(30) Foreign Application Priority Data

Jan. 9, 2017 (EP) ..... 17150689

(51) Int. Cl.
*F04D 29/60* (2006.01)
*F04D 13/08* (2006.01)
*B01F 7/00* (2006.01)

(52) U.S. Cl.
CPC ..... *F04D 29/607* (2013.01); *F04D 29/605* (2013.01); *F04D 29/606* (2013.01); *B01F 7/00741* (2013.01); *F04D 13/08* (2013.01)

(58) Field of Classification Search
CPC ..... F04D 13/08; F04D 29/605; F04D 29/606; F04D 29/607; B01F 7/00733; B01F 7/00741; B01F 15/00662; B66B 7/023
(Continued)

(56) References Cited

U.S. PATENT DOCUMENTS 3,313,347 A 4/1967 Crain
3,427,982 A * 2/1969 Englesson ..... F04D 29/607 415/126

(Continued)

FOREIGN PATENT DOCUMENTS

EP 0757182 A1 * 2/1997 ..... F04D 29/607
WO 2015170222 A1 11/2015

OTHER PUBLICATIONS

International Search Report and Written Opinion for International Application No. PCT/EP2018/050311, dated Mar. 26, 2018—8 pages.

*Primary Examiner* — Zachary L Kuhfuss
(74) *Attorney, Agent, or Firm* — RatnerPrestia

(57) ABSTRACT

A submersible machine guide assembly suitable for guiding a submersible machine from an upper position towards an operative position. The guide assembly includes a top mount configured to be arranged at the upper region of the tank, a supporting member configured to be arranged in the tank, and two guide wires running along each other in the vertical direction of the tank. Each of the guide wires is connected to the top mount at a first end and is connected to a seat of the supporting member at a second end. A runner is displaceable along the guide wires. The runner includes two guide members that engage the guide wires and that are connected to each other at the lower ends thereof. The lower end of each guide member is configured to engage the
(Continued)

corresponding seat of the supporting member when the runner is in the operative position.

8 Claims, 4 Drawing Sheets

(58) Field of Classification Search
USPC ..... 417/360, 361; 366/261, 285, 286; 210/236, 237
See application file for complete search history.

(56) References Cited

U.S. PATENT DOCUMENTS

| | | | | | |
|---|---|---|---|---|---|
| 3,603,385 | A | | 9/1971 | Jones | |
| 3,626,488 | A | * | 12/1971 | Heumann | F16L 37/26 414/787 |
| 3,635,606 | A | * | 1/1972 | Blum | F04D 29/607 417/360 |
| 3,771,915 | A | * | 11/1973 | Back | F04D 29/607 417/360 |
| 4,043,707 | A | * | 8/1977 | Heumann | F04D 29/607 417/360 |
| 4,324,531 | A | * | 4/1982 | Sarvanne | F04D 29/607 417/360 |
| 5,338,116 | A | | 8/1994 | Spörl | |
| 2020/0040913 | A1 | * | 2/2020 | Owesson | B01F 7/00741 |

* cited by examiner

SUBMERSIBLE MACHINE GUIDE ASSEMBLY

TECHNICAL FIELD OF THE INVENTION

The present invention relates generally to the field of devices/assemblies for guiding submersible machines into tanks/receptacles, from the top of the tank towards an operative position of the submersible machine in the tank. The tank/receptacle is configured to house liquid, such as wastewater. The present invention relates specifically to the field of guide assemblies for submersible pumps. A submersible machine is designed and configured to be able to operate in a submerged configuration/position, i.e. be located entirely under the liquid surface in the tank. Thus, in the most preferred embodiment the present invention relates to a guide assembly suitable for use in a wastewater treatment plant.

An inventive guide assembly intended for submersible machines comprises a top mount, a supporting member, two guide wires, a runner and a sliding bracket.

The top mount is configured to be arranged at the upper region of the tank, i.e. at the top of the tank, and the supporting member is configured to be arranged in the tank, e.g. at the bottom of the tank. The two guide wires are running along each other in the vertical direction of the tank, wherein each of said guide wires is connected to the top mount at a first end, i.e. upper end, and is connected to a seat of the supporting member at a second end, i.e. lower end. The runner is configured to be displaceable along said guide wires, between the top mount and the supporting member. The runner comprises two guide members that engage the guide wires and that are connected to each other at the lower ends thereof, wherein the lower end of each guide member is configured to engage a corresponding seat of the supporting member when the runner is in the operative position. The sliding bracket is configured to be connected to the submersible machine and configured to engage the runner.

BACKGROUND OF THE INVENTION

The far most common way to land/position a submersible machine in the correct operative position in the tank is to use a guide rail assembly, see for instance applicants own WO2015/170222. A guide rail assembly comprises long guide rails, i.e. metal pipes having for instance squared or circular cross section. Said guide rails are connected to the wall of the tank at several locations by means of guide rail holders/brackets. In deep tanks, e.g. about 8-12 meters, each guide rail must be constituted by a number of guide rail segments connected in series, wherein each guide rail segment is constituted by (or cut from) a standard pipe having a length of for instance 3 or 6 meters. Each guide rail segment and guide rail holder is expensive to manufacture, handle and to ship to the location of the tank/receptacle. Usually the guide rails are bought locally in order to minimize transportation costs, however this also leads to that the quality of the guide rail and cooperation with the guide rail holders/brackets can not be predicted/foreseen before installation.

In applications intended for submersible pumps, the pump is usually guided/lowered towards and engages a discharge connection located at the bottom of the tank. It is crucial to obtain a correct landing of the pump in relation to the discharge connection in order to avoid leakage during operation of the pump, and when the pump is in the operative position the guide rails are usually not in contact with the sliding bracket of the pump. Thereto, if the submersible machine is not correctly landed/positioned it might lead to generation of vibrations during operation of the submersible machine.

Document U.S. Pat. No. 5,338,116 disclose a guide assembly for a submersible mixer, in accordance with the preamble of claim 1. According to said document the mixer unit is connected to a frame that is lowered into a guide slide, wherein the guide slide is detachably connected to the frame. Thereafter, the mixer, frame and guide slide are jointly lowered into the receptacle all the way to the landing/operative position.

OBJECT OF THE INVENTION

The present invention aims at obviating the aforementioned disadvantages and failings of previously known submersible machine guide assembly, and at providing an improved submersible machine guide assembly. A primary object of the present invention is to provide an improved submersible machine guide assembly of the initially defined type which guarantees proper landing/positioning of the submersible machine in the operative position.

It is another object of the present invention to provide a submersible machine guide assembly, which is compact to ship and easy to handle, and thereby the entire submersible machine guide assembly may be packed and shipped to the location of the tank/receptacle without the need to buy local guide rails. It is another object of the present invention to provide a submersible machine guide assembly which is configured to match tanks/receptacles of different heights. It is yet another object of the present invention to provide a submersible machine guide assembly that requires less amount of metal and fewer components, such as guide rail segments and guide rail holders/brackets, and thereby generate minimal environmental footprint.

SUMMARY OF THE INVENTION

According to the invention at least the primary object is attained by means of the initially defined submersible machine guide assembly having the features defined in the independent claim. Preferred embodiments of the present invention are further defined in the dependent claims.

According to the present invention, there is provided a submersible machine guide assembly of the initially defined type, which is characterized in that the guide members of the runner are connected to each other at the upper ends thereof, and in that the sliding bracket is displaceable along the guide members of the runner when the runner is located in the operative position.

Thus, the present invention is based on the insight of letting the runner land properly and be located in its operative position before the sliding bracket, i.e. the submersible machine, is properly landed and reaches its operative position. Thereby, the sliding bracket, i.e. the submersible machine, experience no technical difference between cooperation with the runner of the inventive submersible machine guide assembly and cooperation with a prior art guide rail solution extending all the way from the top of the tank to the operative position, in connection with the landing/positioning of the submersible machine.

According to a preferred embodiment of the present invention, the two guide members of the runner are stationary connected to each other at the lower ends thereof and releasably connected to each other at the upper ends thereof. This means that the guide members are rigidly connected to each other at the same time as the sliding bracket in a controlled way may be removed/disengaged from the runner.

According to a preferred embodiment, at least one guide member comprises internal engagement means. Said internal engagement means is configured to keep the corresponding guide wire free from large solid matter which otherwise might have negative effect on the function of the guide assembly. According to a more preferred embodiment, external engagement means are provided at the upper end of the corresponding guide wire, wherein the external engagement means are configured to engage the internal engagement means when the runner is located in the upper position. Thereby the runner will be automatically secured at the upper position when the sliding bracket, i.e. the submersible machine, has been hoisted to the upper position.

According to a preferred embodiment, a spring assembly is arranged between the upper end of each guide wire and the top mount. Thereby proper guide wire tensioning is obtained at the same time as the risk of guide wire breakage during hoisting/lowering is reduced/avoided.

According to a preferred embodiment, the runner has a vertical length that is equal to or more than 0.5 meters and equal to or less than 1.2 meters. Thereby, proper landing of the runner before landing of the sliding bracket, i.e. the submersible machine, is guaranteed at the same time as the guide assembly can be easily handled/shipped.

Further advantages with and features of the invention will be apparent from the other dependent claims as well as from the following detailed description of preferred embodiments.

BRIEF DESCRIPTION OF THE DRAWINGS

A more complete understanding of the abovementioned and other features and advantages of the present invention will be apparent from the following detailed description of preferred embodiments in conjunction with the appended drawings, wherein.

DETAILED DESCRIPTION OF PREFERRED EMBODIMENTS OF THE INVENTION

Figure 1:
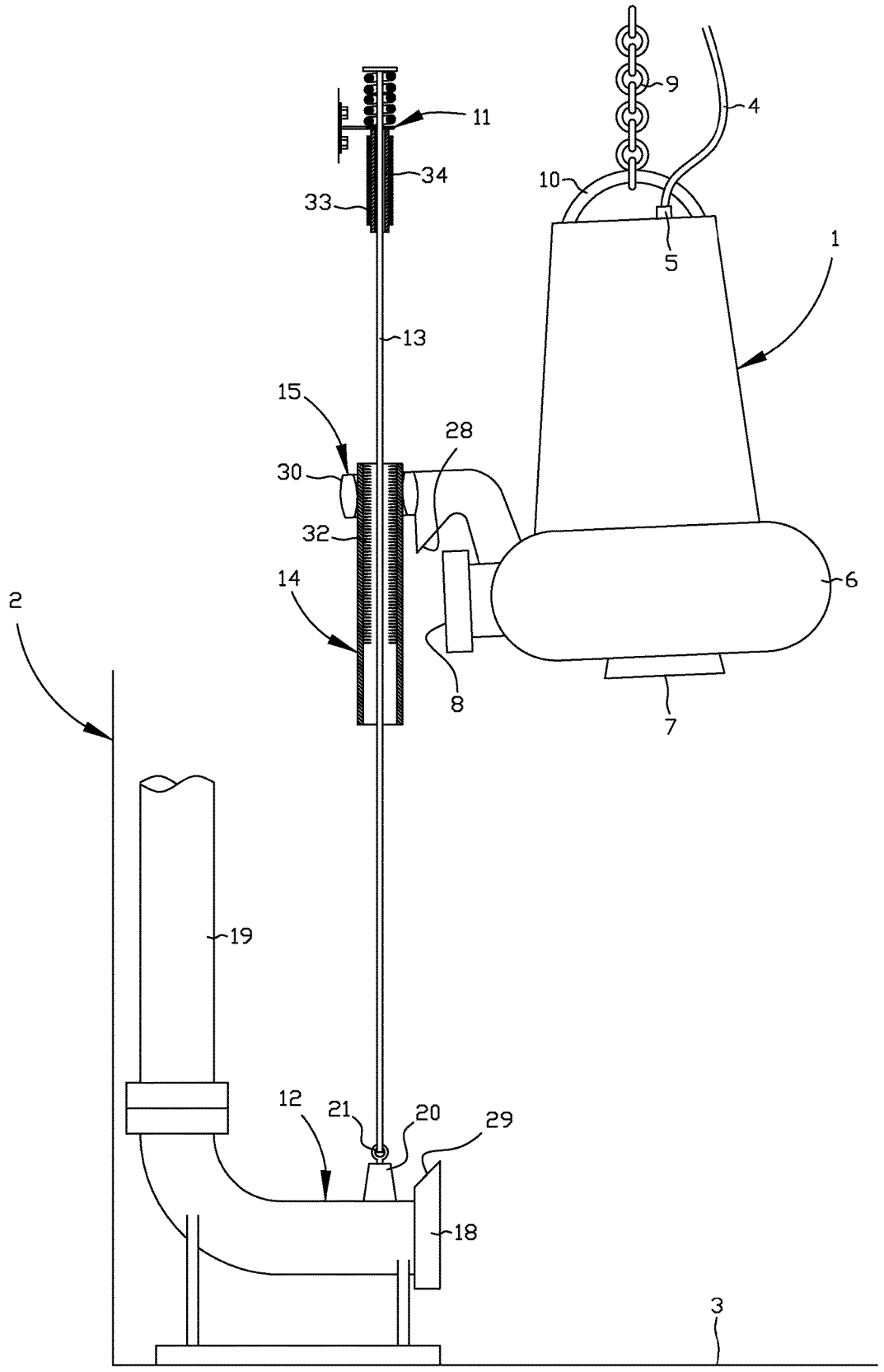
FIG. 1 is a schematic side view of an inventive submersible machine guide assembly together with a submersible pump and a discharge connection, wherein the runner of the guide assembly and the pump are lowered towards the discharge connection (operative position)

The present invention relates to a submersible machine guide assembly, i.e. a guide assembly configured for guiding a submersible machine 1 into a tank/receptacle 2, wherein said tank 2 is configured to house liquid, especially wastewater. Thus, the inventive guide assembly is in the preferred embodiment configured for use in a wastewater treatment plant such as a wastewater pump station, a racetrack, a digester, etc.

A submersible machine 1 is designed and configured to be able to operate in a submerged configuration/position, i.e. during operation be located entirely under the liquid surface in the tank 2. Thus, an operative position of the submersible machine 1 is located inside the tank 2 and the guide assembly is configured to guide the submersible machine from the top of the tank 2 towards said operative position. The operative position of the submersible machine is in the preferred embodiment located at the bottom 3 of the tank 2. The axial depth of the tank 2 is usually in the range up to 12-15 meters, and usually at least 6 meters.

It shall be realized that a submersible machine 1 during operation must not be entirely located under the liquid surface but may continuously or occasionally be partly located above the liquid surface in the tank 2. Submersible machines as referred to herein, comprises an electrical motor arranged in a liquid tight housing, preferably made of metal, and a drive shaft extending from the electrical motor. An impeller/propeller is connected to the drive shaft and is driven in rotation by said drive shaft and electrical motor during operation of the submersible machine 1. The electrical motor is powered via an electrical cable 4 extending from the top of the tank 2, and the submersible machine 1 comprises a liquid tight lead-through 5 receiving said electrical cable 4. The submersible machine 1 may also comprise a control unit, such as an intelligent drive or VFD, located inside the liquid tight housing. The components of the submersible machine are usually cold down by means of the liquid surrounding the submersible machine.

The submersible machine 1 is in the preferred embodiment constituted by a submersible pump, especially a wastewater pump. However, it shall be realized that also other submersible machines are conceivable such as a submersible mixer, especially a wastewater mixer. Hereinafter the present invention will be described in detail in connection with a pump station and a submersible pump, however not limited thereto. Reference is made to all figures.

The submersible pump 1 comprises an impeller located in a volute 6, wherein the impeller during operation of the pump 1 is configured to draw liquid into said volute 6 through an inlet 7 and discharge liquid from said volute 6 though an outlet 8. The pump 1 is hoisted and lowered by means of a chain/wire 9 connected to a handle 10 arranged at the top of the pump 1. The chain/wire 9 may be disconnected from the pump 1 when the pump 1 is in the operative position in the tank 2.

The inventive submersible machine guide assembly comprises a top mount 11, a supporting member 12, two guide wires 13, a runner 14 and a sliding bracket 15.

The top mount 11 is configured to be arranged at the upper region of the tank 2. i.e. accessible by an operator preferably from an upper opening of the tank 2. In a pump station application (or the like applications) the upper opening is closed by a manhole cover or the like during operation, and the top mount 11 is located inside the tank 2. In a racetrack application (or the like applications) the tank 2 is upon upwards and the top mount may be located above the upper rim of the tank 2. The top mount 11 is configured to be rigidly attached to a stationary structure, such as the inside of the tank wall or underside of the tank roof, by means of bolts or the like. It shall be pointed out that the top mount 11 may comprises two separate elements but still considered as a single top mount arrangement.

In the most elementary embodiment, the top mount 11 is constituted by two eyebolts connected to the tank 2. In the preferred and disclosed embodiment the top mount 11 comprises an attachment plate 16 and two angled-shaped cantilevers 17 connected to and projecting from the attachment plate 16, wherein the free ends of the cantilevers 17 are heading each other.

The supporting member 12 is configured to be arranged in the tank 2, preferably at the lower region of the tank 2. The supporting member 12 is configured to be rigidly attached to a stationary structure, such as the tank bottom 3, by means of bolts or the like. The supporting member 12 is configured to receive the submersible machine 1, when the submersible machine is in the operative position. In a pump station application the supporting member 12 is constituted by a discharge connection. In a mixer application the supporting member 12 is constituted by a seat/stand. The disclosed discharge connection 12 comprises an inlet 18, wherein the outlet 8 of the pump 1 is configured to engage said inlet 18 of the discharge connection 12 when the pump 1 is in the operative position. The discharge connection 12 is connected to an outlet pipe 19 in a conventional way.

Said two guide wires 13 are configured to run along each other in the vertical direction of the tank 2. Each guide wire 13 is connected to the top mount 11 at a first/upper end of the guide wire 13 and connected to a seat 20 of the supporting member 12 at a second/lower end of the guide wire 13. The guide wires 13 are preferably made of twisted steel wire. In the disclosed embodiment the seat 20 of the discharge connection 12 is constituted by an upright projection, preferably in the shape of a truncated cone. The guide wire 13 is connected to the top of the upright projection, preferably by means of an eyebolt 21 of less radial extension than the upright projection.

Preferably each guide wire 13 is provided with a tensioning assembly, and in the preferred embodiment the tensioning assembly is constituted by a spring assembly 22 arranged between the first/upper end of the guide wire 13 and the top mount 11. In the disclosed embodiment, the spring assembly 22 comprises a compression spring 23 arranged on the upper side of the cantilever 17 of the top mount 11, wherein the first/upper end of the guide wire 13 is connected to the upper end of the compression spring 23, e.g. by means of a washer 24 or the like. Preferably the compression spring 23 is arranged about the guide wire 13. During installation of the guide assembly the lower end of the guide wire 13 is connected to the supporting member 12 and when the guide wire 13 has the correct length the upper end of the guide wire 13 is connected to the upper end of the biased compression spring 23. Thus, the guide wires 13 may have a raw length exceeding the specific installation depth.

The runner/slide 14 is configured to be displaced along said guide wires 13, between the top mount 11 and the supporting member 12. The runner 14 comprises two guide members 25, wherein each guide member 25 engage one guide wire 13 each. The lower end of each guide member 25 is configured to engage the corresponding seat 20 of the supporting member 12 when the runner 14 is in its operative position. The two guide members 25 are extending along each other and are preferably arranged in parallel to each other. The guide members 25 are rigidly connected to each other at the lower ends thereof, by means of a lower cross bar 26. Thereto, the guide members 25 are connected to each other at the upper ends thereof, by means of an upper cross bar 27. Preferably the guide members 25 are releasable connected to each other at the upper ends thereof.

In the preferred embodiment the guide members 25 are constituted by guide pipes, wherein the guide pipes 25 are arranged about the guide wires 13. In an alternative embodiment the guide members 25 are constituted by elements having approximately U-shaped cross section, wherein the U-shaped elements are open away from each other and the guide wires 13 are arranged surrounded by the U-shaped elements. According to an alternative embodiment each guide member 25 is constituted by a guide pipe having an axially extending slot configured to receive the guide wire 13. Radially open guide members 25 entail that the runner 14 may be installed after the guide wires 13 are installed. Preferably, the runner 14, i.e. the guide members 25, has a vertical length that is equal to or more than 0.5 meters and equal to or less than 1.2 meters, preferably in the range 0.8-1 meters.

The sliding bracket 15 is configured to be connected to the submersible machine 1 and configured to engage the runner 14. In the preferred embodiment the sliding bracket 15 is rigidly and stationary connected to the submersible machine 1. The sliding bracket 15 comprises an abutment surface 28 configured to abut/engage a corresponding abutment surface 29 of the supporting member 12, when the submersible machine is in its operative position. In the disclosed embodiment the pump 1 will hang from the discharge connection 12 by means of the sliding bracket 15 such that the outlet 8 of the pump 1 rest against the inlet 18 of the discharge connection 12 due to the weight of the pump 1.

The sliding bracket 15 comprises a guide member fork 30, said guide member fork 30 being configured to cooperate with the guide members 25 of the runner 14, such that the sliding bracket 15 is displaceable along the guide members 25 of the runner 14, i.e. in the vertical direction, at least when the runner 14 is located in its operative position. The guide member fork 30 is configured to have little or no play in the radial direction in relation to the guide members 25 of the runner 14, such that the submersible machine 1 can be properly landed/positioned at the operative position after the runner 14 has reached its operative position.

In the embodiment wherein the guide members 25 of the runner 14 are releasable connected to each other at the upper ends thereof, the sliding bracket 15 may be removed from the engagement with the runner 14 when the runner 14 is located at the top mount 11. In the disclosed embodiment the upper cross bar 27 is pivotably connected to one of the guide members 25. The upper cross bar 27 is biased into a position wherein the upper cross bar 27 bridge over the distance between the guide members 25 and is abutting a seat 31 of the other guide member 25. Thus, the upper cross bar 27 may be located in a first position allowing the sliding bracket 15 to engage and disengage the runner 14, and be located in a second position securing the engagement between the sliding bracket 15 and the runner 14. Preferably the upper cross bar 27 is arranged to pivot in an axially extending plane.

According to the disclosed embodiment at least one guide member 13, preferably both guide wires, comprises internal engagement means 32. Said internal engagement means 32 is preferably made of bristles connected to the inner surface of the guide member 25. The internal engagement means 32 are configured to remove solid matter from the guide wires 13. Thereto, it is preferred that external engagement means 33 are provided at the upper end of the corresponding guide wire 13. Said external engagement means 33 is preferably made of bristles connected to the outer surface of a pipe segment 34 that is connected to the cantilever 17 of the top mount 11. Thus, the external engagement means 32 is configured to engage the internal engagement means 33 when the runner 14 is located in the upper position, like "Velcro".

Figure 2:
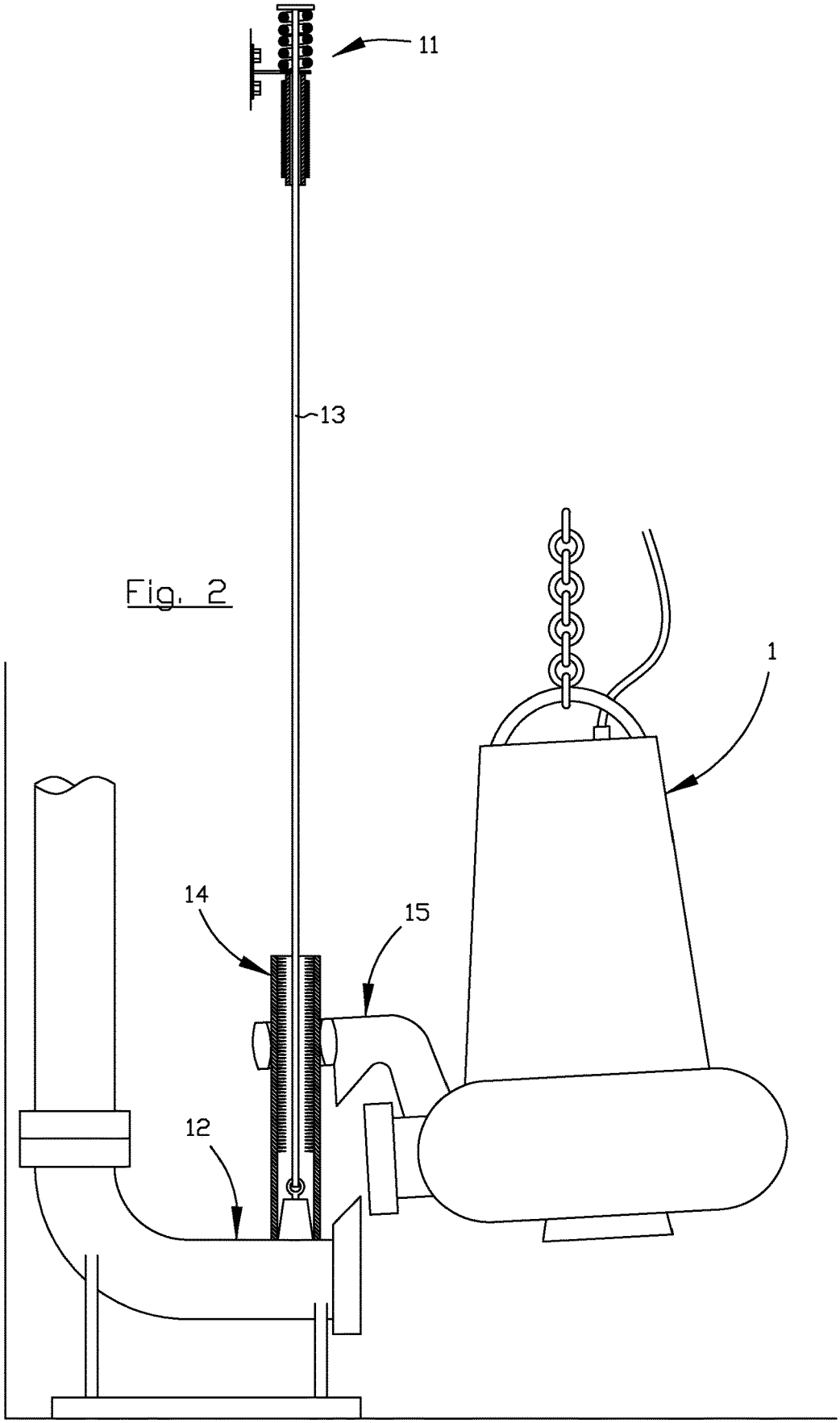
FIG. 2 is a schematic side view of the submersible machine guide assembly according to FIG. 1, wherein the runner of the guide assembly is in the operative position and the pump is displaced in relation to the runner and lowered towards the discharge connection (operative position)
Figure 3:
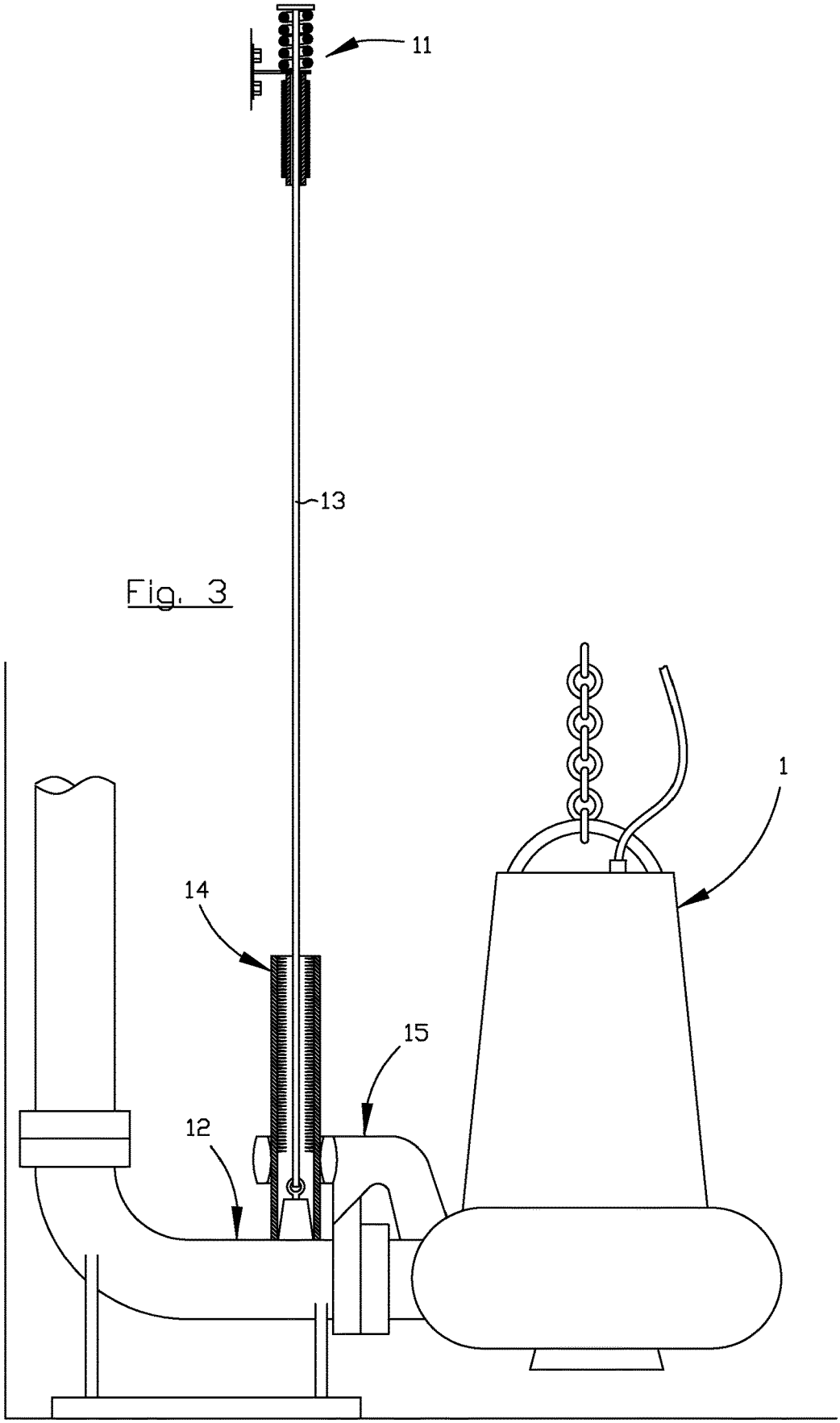
FIG. 3 is a schematic side view of the submersible machine guide assembly according to FIGS. 1 and 2, wherein the runner of the guide assembly and the pump are located in the respective operative position.
Figure 4:
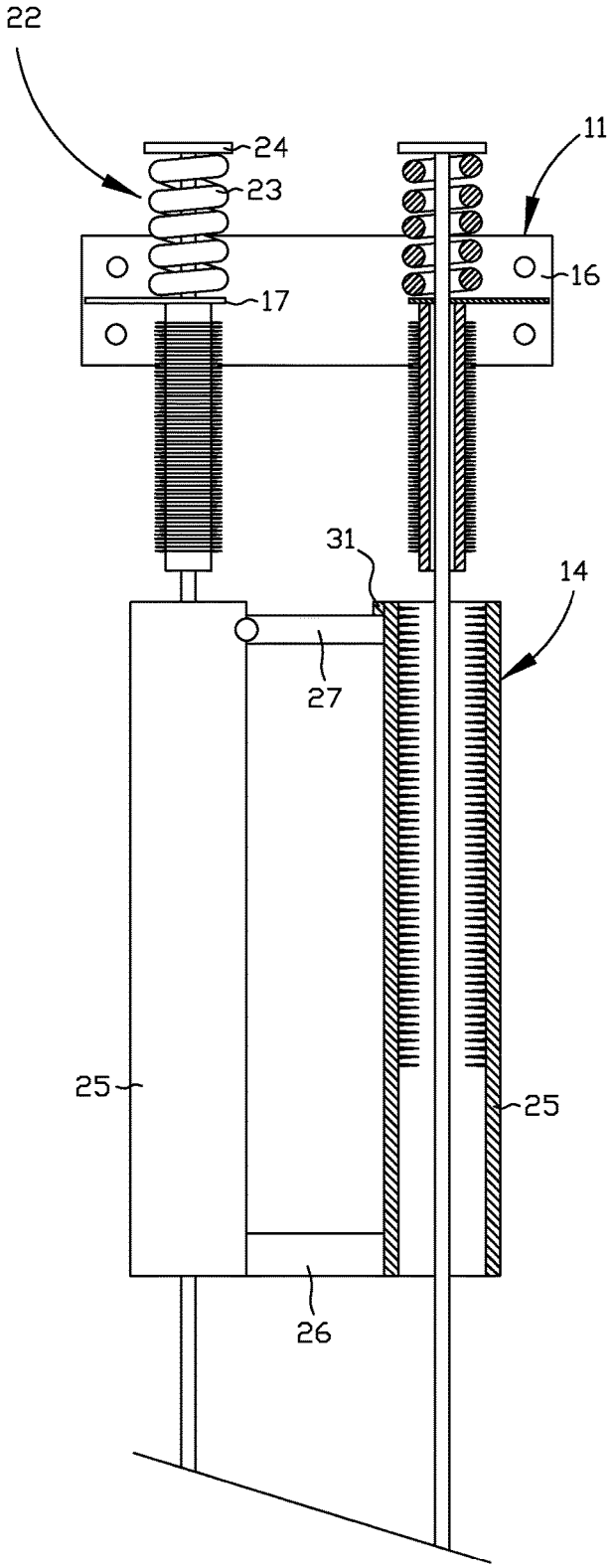
FIG. 4 is a schematic front view of a part of the inventive submersible machine guide assembly, partially cross sectioned.
Figure 5:
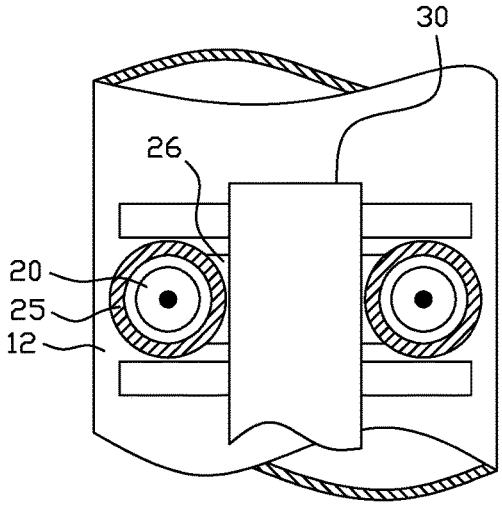
FIG. 5 is a schematic view from above of the runner and a section of the sliding bracket.

The function of the inventive guide assembly during lowering. The runner 14 is kept at the upper position adjacent the top mount 11. The sliding bracket 15 engages the runner 14 and the runner 14 is released from its upper position adjacent the top mount 11. The submersible machine 1 is lowered by means of the chain 9 and the runner is hanging in from the sliding bracket 15 by means of the upper cross bar 27, see FIG. 1. Thereafter the runner 14 engage the supporting member 12 and the submersible machine 1 is lowered further towards the supporting member 12, see FIG. 2. Thereafter the submersible machine 1 engage the supporting member 12, see FIG. 3.

The function of the inventive guide assembly during hoisting. The submersible machine 1 is hoisted from the operative position and is displaced in relation to the runner 14, see FIG. 2. The sliding bracket 15 engage the upper cross bar 27 of the runner 14 and brings the runner 14 upwards, see FIG. 1. When the runner 14 reaches its upper position, the runner 14 is secured, and thereafter the sliding bracket 15 may be removed/disengaged from the runner 14.

Feasible Modifications of the Invention

The invention is not limited only to the embodiments described above and shown in the drawings, which primarily have an illustrative and exemplifying purpose. This patent application is intended to cover all adjustments and variants of the preferred embodiments described herein, thus the present invention is defined by the wording of the appended claims and thus the equipment may be modified in all kinds of ways within the scope of the appended claims.

It shall also be pointed out that all information about/concerning terms such as above, under, upper, lower, etc., shall be interpreted/read having the equipment oriented according to the figures, having the drawings oriented such that the references can be properly read. Thus, such terms only indicates mutual relations in the shown embodiments, which relations may be changed if the inventive equipment is provided with another structure/design.

It shall also be pointed out that even thus it is not explicitly stated that features from a specific embodiment may be combined with features from another embodiment, the combination shall be considered obvious, if the combination is possible.

The invention claimed is:

1. A submersible machine guide assembly configured for guiding a submersible machine from an upper position towards an operative position, the submersible machine guide assembly comprising:

a top mount configured to be arranged at an upper region of a tank, a supporting member configured to be arranged in the tank, two guide wires running along each other in a vertical direction of the tank, wherein each of said guide wires is connected to the top mount at a first end and is connected to a seat of the supporting member at a second end, a runner that is configured to be displaced along said guide wires, the runner comprising two guide members that engage the guide wires and that are connected to each other at lower ends thereof, wherein the lower end of each guide member is configured to engage the corresponding seat of the supporting member when the runner is in an operative position, and a sliding bracket configured to be connected to the submersible machine and configured to engage the runner, wherein the guide members are connected to each other at upper ends thereof, and the sliding bracket is configured to be displaced along the guide members of the runner when the runner is located in the operative position.

2. The submersible machine guide assembly according to claim 1, wherein the submersible machine guide assembly is constituted by a submersible pump guide assembly, and wherein the supporting member is constituted by a discharge connection.

3. The submersible machine guide assembly according to claim 1, wherein the two guide members of the runner are fixedly connected to each other at the lower ends thereof and releasably connected to each other at the upper ends thereof.

4. The submersible machine guide assembly according to claim 1, wherein at least one guide member comprises internal engagement means.

5. The submersible machine guide assembly according to claim 1, further comprising external engagement means at the upper end of the corresponding guide wire, wherein the external engagement means are configured to engage the internal engagement means when the runner is located in the upper position.

6. The submersible machine guide assembly according to claim 1, further comprising a spring assembly arranged between the first end of each guide wire and the top mount.

7. The submersible machine guide assembly according to claim 1, wherein the runner has a vertical length that is equal to or more than 0.5 meters and equal to or less than 1.2 meters.

8. The submersible machine guide assembly according to claim 1, wherein each seat is constituted by an upright projection.

* * * * *